US005382869A

United States Patent [19]

Williamson et al.

[11] Patent Number: 5,382,869

[45] Date of Patent: Jan. 17, 1995

[54] LAMP BASE INNER SHELL

[75] Inventors: Glen P. Williamson, Manchester; Donald W. Lilljedahl, Pittsfield, both of N.H.

[73] Assignee: Osram Sylvania Inc., Danvers, Mass.

[21] Appl. No.: 980,861

[22] Filed: Nov. 24, 1992

[51] Int. Cl.[6] ..... H01J 5/50

[52] U.S. Cl. ..... 313/318; 313/567; 439/612; 439/615

[58] Field of Search ..... 313/318, 51, 484, 570, 313/572, 624, 567, 625; 439/602, 611, 612, 613, 614, 615, 617, 619, 618

[56] References Cited

U.S. PATENT DOCUMENTS 2,848,643 8/1958 Spataro ..... 313/318

4,121,134 10/1978 Fontenelle ..... 313/51 X

*Primary Examiner*—Donald J. Yusko

*Assistant Examiner*—Ashok Patel

*Attorney, Agent, or Firm*—Joseph S. Romanow; William H. McNeill

[57] ABSTRACT

A lamp base inner shell including a washer-like base having a cylindrically wall attached at a first end to an outer periphery of the base. The cylindrical wall includes a threaded portion and a plurality of cut-out portions in a second end thereof which define an equal number of tabs, each tab having an indentation extending inwardly. At least one cut-out portion extends to the inner shell base. The inner shell is used to electrically connect and secure a lamp base shell to a lamp tube. The inner shell facilitates automated production of high intensity arc discharge lamps.

6 Claims, 3 Drawing Sheets

LAMP BASE INNER SHELL

1. Field of the Invention:

The present invention pertains to a lamp base inner shell and, more particularly, to a lamp base inner shell for automated production of high intensity discharge lamps.

2. Description of the Prior Art:

Most lamps utilize lamp base shells to facilitate insertion and removal into a complementary lamp socket and to establish electrical contact between the lamp and the socket. Several structures have been developed to prevent the lamp base shell from separating from the lamp base, particularly when the lamp is removed from-the socket at the end of its useful life.

One configuration used to electrically connect a lamp to a base shell, and mechanically secure the base shell, utilizes a threaded inner shell, as shown in FIGS. 1A–1E. Inner shell 10 has a washer-like base 11 having an outer rim 12 and an inner rim 13, which define surface 14 and opening 15. The inner shell 10 further includes a cylindrically-shaped body having screw threads 16, extending from base 11 to a plurality of cut-out portions 17. Cut-out portions 17 define an equal number of tabs 18. Tabs 18 each have an indentation 19, or dimple, which corresponds with a depression molded in the neck of the lamp base (not shown). Inner shell 10 is secured to the lamp base by manually placing it over the base until the dimples are mated with the corresponding depressions in the lamp tube. The lamp base typically extends into inner shell 10 up to the beginning of screw threads 16, about the length of cut-out portions 17 and tabs 18. When inner shell 10 is in place, a lamp base shell is securely screwed onto threads 16 and is staked, or pierced, to engage it with the inner shell. The base shell is staked into threads 16 to prevent inadvertent cracking of the lamp base which does not extend behind threads 16. In addition to the initial mating of indentations 19 with depressions molded in the lamp base, the tightening of the lamp base shell on inner shell 10 forces tabs 18 and indentations 19 closer to the lamp base. Inner shells are typically made from any of the materials including nickel, nickel-iron alloy, cold-rolled steel, or nickel-plated steel to provide a compatible welding surface for two lead wires, typically extending from the lamp base. A side, or ground, lead wire is resistance welded to the outer portion of surface 14 prior to the securing and staking of the lamp base shell. A center lead wire typically passes through an eyelet in the base portion of the inner shell and the lamp base shell, where it is trimmed, fluxed, and soldered. This configuration, while securing the lamp base shell and providing electrical contact, requires several parts and difficult manual assembly, particularly with respect to welding the side lead wire to surface 14 of inner shell 10. This approach results in costly, time consuming, and inefficient lamp production.

A more efficient, automated method to electrically connect the lamp's lead wires to the lamp base shell, and mechanically secure the base shell to the lamp base, uses a lead solder preform. The lead solder preform is typically made from a 10% tin, 90% lead alloy. The solder preform can be formed in a die into a variety of shapes and sizes to conform with a depression that is molded into the glass neck of the lamp base. The solder preform is first placed into the depression, and the side lead wire is temporarily retained therein by being pressed into the exposed surface of the soft solder preform. The lamp base shell is then placed onto the lamp base, covering the side lead wire and solder preform. The center lead wire is soldered to the lamp base shell as described above. Heat is then applied to the lamp base shell to melt the solder preform. When cooled, the solder secures the side lead wire and the lamp base shell.

Although providing a more efficient automated production technique, use of lead solder has several disadvantages. First, lead solder is an environmental pollutant. Therefore, as environmental laws and regulations continue to impose new and increasingly stringent standards the lamp industry is attempting to phase out the use of lead solder. Second, the use of lead solder increases both direct and indirect costs associated with lamp production. Lead solder is an expensive material and, further, soldering discolors the brass or copper-nickel alloy base shells typically used in high intensity discharge lamp applications. More expensive nickel-plated base shells must be used to maintain good aesthetics, thereby increasing the overall cost of lamp production.

It is therefore an object of the present invention to provide an improved lamp base inner shell which is cost effective and provides for an efficient assembly line operation.

It is a further object of the present invention to provide an improved lamp base inner shell for automated production of high intensity discharge lamps.

SUMMARY OF THE INVENTION

According to the present invention, a lamp base inner shell comprises a washer-like base having a cylindrical wall attached to a first end to an outer periphery of the base. The cylindrical wall includes a threaded portion and a plurality of cut-out portions in a second end thereof which define an equal number of tabs having inwardly-extending indentations. At least one of the cut-out portions extends to the washer-like base.

The modified lamp base inner shell of the present invention is used to electrically connect a lamp to a lamp base shell and to secure the lamp base shell onto a lamp tube. The inner shell is placed onto the lamp base until the indentations, located on the tabs, are mated with depressions typically molded in the neck of the lamp tube. The lamp base extends into the inner shell a distance equivalent to the length of the cut-out portions and tabs. One cut-out portion extends to the washer-like base to provide access within the inner shell while resistance welding the lamp's ground lead wire to the outer portion of the inner shell base. The ground lead wire extends from the lamp base through an opening in the inner shell's washer-like base where it is folded onto the base and welded. A second lead wire also passes through the opening in the washer-like base. After the ground lead wire is welded to the lamp base inner shell, the lamp base shell is screwed onto the threaded portion of the inner shell and covers the tabs and cut-out portions. The lamp base shell is staked above the threaded portion of the inner shell to secure it to the inner shell. The second lead wire also passes through an eyelet in the base portion of the lamp base shell, where it is trimmed, fluxed and soldered.

BRIEF DESCRIPTION OF THE DRAWINGS

The foregoing and other objects and advantages of the present invention will be more fully appreciated from the following drawings, in which.

DETAILED DESCRIPTION OF THE INVENTION

Figure 1A:
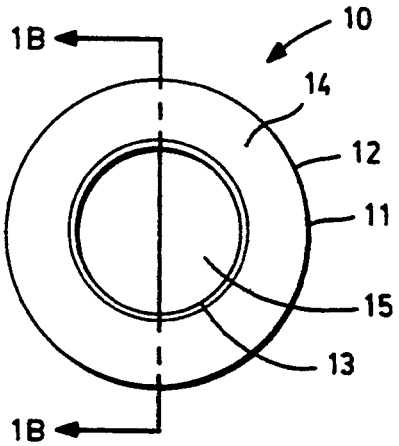
FIG. 1A PRIOR ART
FIG. 1A is a top plan view of a prior art inner shell.
Figure 1C:
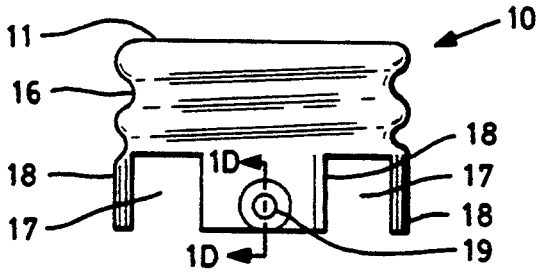
FIG. 1C PRIOR ART
FIG. 1C is a side elevation view of the prior art inner shell shown in FIG. 1A.
Figure 1E:
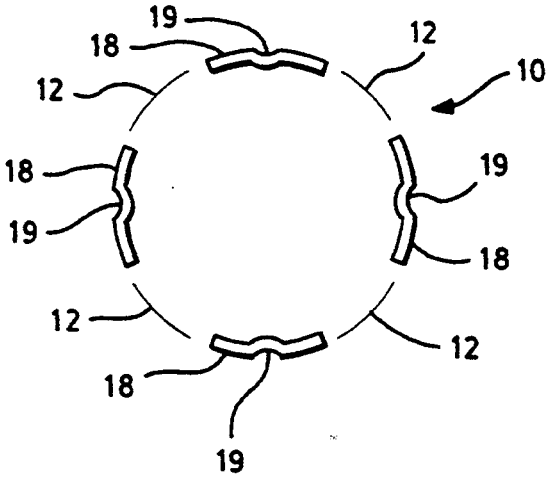
FIG. 1E PRIOR ART
FIG. 1E is a bottom plan view of the prior art inner shell shown in FIG. 1A.
Figure 1B:
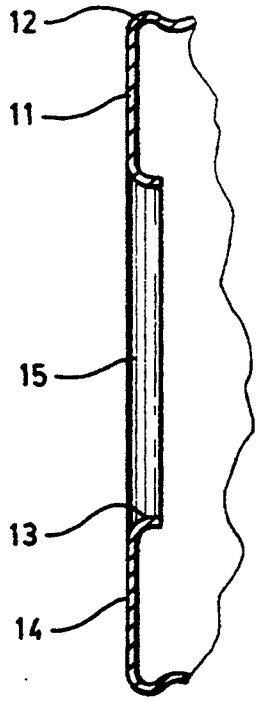
FIG. 1B PRIOR ART
FIG. 1B is a partial cross-sectional view, taken along line 1B—1B of FIG. 1A.
Figure 1D:
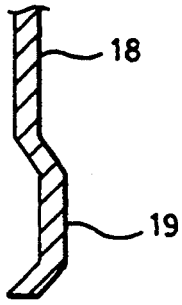
FIG. 1D PRIOR ART
FIG. 1D is a partial cross-sectional view, taken along line 1D—1D of FIG. 1C.
Figure 2:
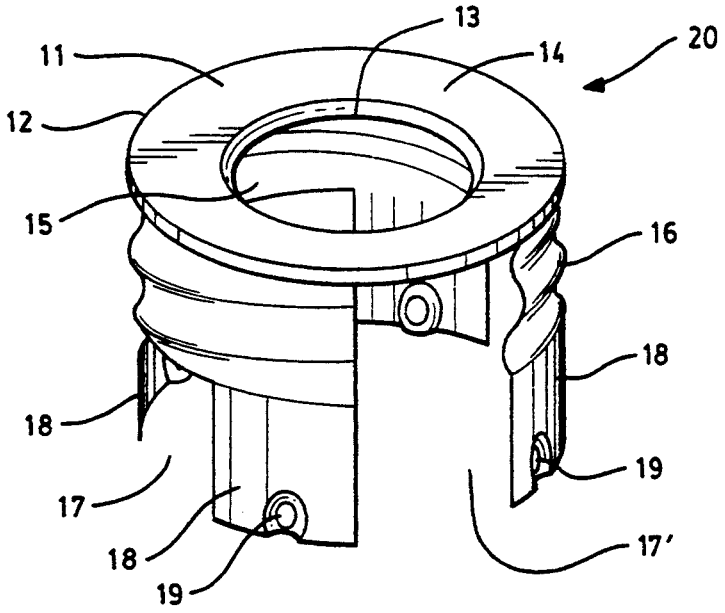
FIG. 2 is a perspective view of the inner shell of the present invention.

The present invention provides a modified lamp base inner shell that is used to secure a lamp base shell to a lamp base. The modified lamp base inner shell of the present invention is shown in FIG. 2. A modified lamp base inner shell 20 includes a washer-like base 11 having an outer rim 12 and an inner rim 13, which define a surface 14 and an opening 15. The inner shell further includes a cylindrically-shaped body having screw threads 16 extending from base 11 to a plurality of cut-out portions 17. Cut-out portions 17 define an equal number of tabs 18, each having an indentation 19 which extends inwardly. One extended cut-out portion 17' extends to the washer-like base 11.

The modified lamp base inner shell 20 is typically made from a metal material which may be compatibly welded to a lamp's ground lead wire (not shown in FIG. 2). Preferably, lamp base inner shell 20 is made of the same nickel material used to make the ground lead wire. More preferably, inner shell 20 is made from cold-rolled steel or nickel plated cold-rolled steel, which can be compatibly welded to nickel ground lead wires and is typically less expensive than solid nickel. Inner shell 20 is formed from a sheet of the selected metal having a thickness of between about 0.015 inch to 0.025 inch. This thickness, however, may vary depending on the size and type of the lamp base.

The modified lamp base inner shell 20 is similar to inner shell 10 shown in FIGS. 1A–E and described above, except for the extended cut-out portion 17' which extends to the outer rim 12 of base 11.

Washer-like base 11 includes outer rim 12 and inner rim 13 which define surface 14 and opening 15. Rims 12 and 13 are typically concentric circles forming an annular surface 14 as well as a circular central opening 15. Surface 14 and opening 15, however, may be formed in various shapes and sizes provided that surface 14 has sufficient surface area for attachment of the lamp's ground lead wire, and opening 15 is sufficiently wide to pass the ground lead wire and a second lead wire (not shown in FIG. 2). Threaded portion 16 extends upwardly from the outer periphery of base 11 approximately one half of the length of inner shell 20. The threads 16 are conventionally rolled or otherwise formed by inward deformation of the inner shell wall so as to establish complementing inner and outer threads in the wall. Cut-out portions 17 extend down to the top of threaded portion 16 and form a plurality of tabs 18. Typically, both cut-outs 17 and tabs 18 are rectangularly shaped. However, various other shapes may be used. Tabs 18 are between about one-third and one-half of the total length of inner shell 20, to provide sufficient contact with the lamp base for lamp stability. Tabs 18 each have an indentation 19 which is typically located at the top end of the tab. Indentations 19 extend inwardly toward the axis of inner shell 20. Indentations 19 may be shaped in any configuration, such that they can be placed into depressions which are typically molded into the lamp base. Preferably, indentations 19 conform with the shape of the molded depressions to provide a tight fit between the inner shell 20 and the lamp base.

In the modified lamp base inner shell 20 of the present invention, at least one extended cut-out portion 17' provides access to the interior of the inner shell 20. Due to the placement of inner shell 20 on a lamp base such that only tabs 18 extend over the lamp base surface, the extended cut-out portion 17' provides access to the lamp base as well as the interior of the inner shell. This extended cut-out portion 17' permits the ground lead wire to be resistance welded to the outer surface 14 in an automated manufacturing process. One electrode, typically about 3/16 inch in diameter, can easily be placed in cut-out portion 17' while a second electrode is placed above the ground lead wire, which passes through opening 15 and is folded upon surface 14. Formerly, the ground lead wire was resistance welded to the outer portion of base 11 by manually manipulating the electrodes and inner shell.

Figure 3:
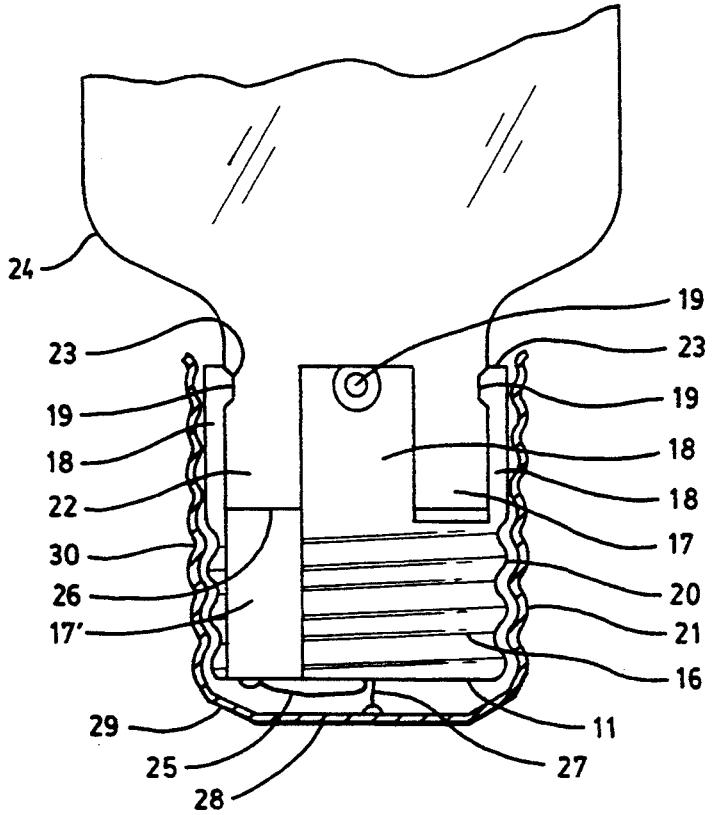
FIG. 3 is a partial cross-sectional view of a lamp including a lamp base shell and a lamp tube utilizing the modified inner shell of the present invention.

Referring now to FIG. 3, modified inner shell 20, including base 11 having a cylindrically shaped threaded portion 16 and a plurality of cut-out portions 17, 17', defining an equal number of tabs 18 having indentations 19 is shown securing a lamp base shell 21 to a lamp base 22.

The assembly process includes placing inner shell 20 over lamp base 22 until indentations 19 are mated with depressions 23, which are typically molded into the lamp base 22 of lamp tube 24. After inner shell 20 is in place, a ground lead wire 25, which extends from the bottom portion 26 of lamp tube 24 and passes through inner shell 20 opening 15 (see FIG. 2), is resistance welded to base 11. A second lead wire 27 also passes through opening 15 of inner shell 20. After ground lead wire 25 is welded to base 11, the lamp base shell 21 is screwed onto inner shell 20 such that tabs 18 and indentations 19 are covered by base shell 21. Base shell 21 is then staked above the hollow threaded portion 16 of inner shell 20 to secure the lamp base shell 21 to the inner shell. Lastly, lead wire 27 is trimmed and fluxed and is soldered, as is known to those skilled in the art, to a base 28 of lamp base shell 21.

Typically, the modified lamp base inner shell 20 of the present invention is used in high intensity arc discharge lamps, including high pressure sodium, mercury, and metal arc lamps. However, as may be apparent to those skilled in the art, the modified lamp base inner shell 20 may also be used with various other metal shell-to-ceramic or glass systems, including, for example, incandescent lamps, fluorescent lamps, flashbulbs, or standard screw-type fuses which utilize various sizes and types of bases.

In a preferred embodiment, the modified lamp base inner shell 20 of the present invention is used to secure a large lamp base shell 21, or mogul, to a high intensity discharge lamp base 22. The lamp base shell 21 is in the form of a thin-walled cylinder, having a diameter of about 1.50 inches and a length of about 1.625 inches, including an inwardly directed flange 29 at one end and screw threads 30 extending from that end toward the other open end into which the high intensity discharge lamp tube 24 and inner shell 20 are inserted. The threads 30 are conventionally rolled or otherwise formed by inward deformation of the shell wall so as to establish complementing inner and outer threads in the wall of the lamp base shell 21. Shell 21 is typically formed from a copper-nickel alloy approximately 0.015 inch thick. The high intensity discharge lamp base 22 has molded frusto-conical depressions 23. The depressions 23 are tapered inwardly from approximately 0.20 inch in diameter at the surface to about 0.075 inch in diameter, and are approximately 0.02 inch deep.

In a preferred embodiment, lamp base inner shell 20 is made from a 0.02 inch thick sheet of a nickel plated, cold-rolled steel. Inner shell 20 includes a washer-like base having a cylindrically-shaped threaded portion 16 extending from its outer periphery, and cut-out portions 17 which define coaxial tabs 18, each having a frusto-conical indentation extending inwardly, and one extended cut-out portion 17' which extends to the base 11. The inner shell 20 is approximately 0.860 inch long, the base has an outside diameter of approximately 1.445 inches and an inside diameter of about 0.875 inch. The threaded portion 16 is approximately 0.515 inch long, while the rectangular shape cut-out portion 17 and tabs 18 are approximately 0.345 inch long. Cut-out portions 17 are also approximately 0.345 inch in width, while tabs 18 are approximately 0.575 inch wide. Extended cut-out portion 17' is approximately 0.840 inch long and 0.345 inch wide. Indentations 19, which have a frusto-conical shape are centered at the end of tab 18, and decrease in diameter from about 0.20 inch at the tab surface to about 0.075 inch at an angle of approximately 35 degrees.

Although particular embodiments of the invention have been described in detail for purposes of illustration, various modifications may be made without departing from the spirit and scope of the present invention. Accordingly, the invention is not to be limited except as by the appended claims.

What is claimed is:

1. An electrically conductive (lamp base) inner shell for a lamp, comprising:

a base:

a cylindrical wall attached at a first end to an outer periphery of said base, said cylindrical wall including a threaded portion and a plurality of tabs upstanding from said cylindrical wall, each of said tabs having an inwardly-extending indentation, and a welding electrode receiving aperture formed in said cylindrical wall adjacent said base.

2. The inner shell of claim 1 wherein said inner shell is made of a material selected from the group consisting of nickel, steel, or nickel-plated steel.

3. The inner shell of claim 1 wherein there are four tabs separated by four rectangular-shaped cut-out portions.

4. The inner shell of claim 1 wherein said indentations are frusto-conical shaped.

5. An inner shell comprising:

a base;

a cylindrical wall attached at a first end to an outer periphery of said base, said cylindrical wall including a threaded portion and a plurality of tabs extending from said cylindrical portion separated by a like plurality of cut-out portions said tabs each having inwardly-extending indentations, and a welding electrode receiving aperture formed in said cylindrical wall, said welding electrode receiving aperture being formed by one of said cut-out portions extending to said base.

6. A lamp assembly, comprising:

a lamp tube comprising a neck portion having a plurality of molded depressions, a bottom and a pair of lead wires extending from said bottom;

an inner shell attached to said lamp tube, said inner shell comprising a base having a central opening therein, a cylindrical wall attached at a first end to an outer periphery of the base, said cylindrical wall including a threaded portion and a plurality of tabs extending therefrom separated by a like plurality of cut-out portions, each tab having an inwardly-extending indentation seated in one of said molded depressions in said lamp neck portion, and a welding electrode receiving aperture formed in said cylindrical wall adjacent said base, one of said pair of lead wires being welded to said base; and a lamp base outer shell attached to said inner shell, said outer shell comprising a threaded, cylindrically shaped wall mated with said threaded portion of said inner shell.

* * * * *